US009221653B2

(12) United States Patent
Bloch et al.

(10) Patent No.: US 9,221,653 B2
(45) Date of Patent: Dec. 29, 2015

(54) FIRE SERVICE ELEVATOR

(75) Inventors: Hanspeter Bloch, Buchrain (CH); Roman Lenk, Hagendorn (CH); Reto Hugentobler, Meggen (CH)

(73) Assignee: Inventio AG, Hergiswil (CH)

( * ) Notice: Subject to any disclaimer, the term of this patent is extended or adjusted under 35 U.S.C. 154(b) by 287 days.

(21) Appl. No.: 13/442,261

(22) Filed: Apr. 9, 2012

(65) Prior Publication Data

US 2012/0255814 A1 Oct. 11, 2012

(30) Foreign Application Priority Data

Apr. 8, 2011 (EP) ..... 11161765

(51) Int. Cl.
*B66B 11/02* (2006.01)

(52) U.S. Cl.
CPC ..... *B66B 11/0226* (2013.01)

(58) Field of Classification Search
CPC B66B 11/0226; B66B 11/008; B66B 5/0081; D07B 2801/22
USPC ..... 187/401, 414
See application file for complete search history.

(56) References Cited

U.S. PATENT DOCUMENTS

| | | | | |
|---|---|---|---|---|
| 6,488,123 | B2 * | 12/2002 | Pitts et al. | 187/251 |
| 6,640,935 | B1 * | 11/2003 | Murakami et al. | 187/401 |
| 7,225,902 | B2 * | 6/2007 | Hashiguchi | 187/401 |
| 7,503,433 | B2 * | 3/2009 | Wang | 187/292 |
| 7,510,056 | B2 * | 3/2009 | Bonatre | 187/401 |
| 8,141,686 | B2 * | 3/2012 | Broyan | 187/401 |
| 8,430,211 | B2 * | 4/2013 | Dif | 187/266 |
| 2004/0195047 | A1 * | 10/2004 | Wang | 187/266 |
| 2005/0230194 | A1 * | 10/2005 | Nakamura | 187/401 |
| 2005/0252726 | A1 * | 11/2005 | Det et al. | 187/401 |
| 2007/0084671 | A1 * | 4/2007 | Ach | 187/261 |
| 2012/0031712 | A1 * | 2/2012 | Bloch et al. | 187/401 |
| 2012/0255816 | A1 * | 10/2012 | Bloch | 187/401 |
| 2012/0266968 | A1 * | 10/2012 | Bloch | 137/1 |
| 2012/0325582 | A1 * | 12/2012 | Bloch | 182/129 |
| 2013/0037354 | A1 * | 2/2013 | Bloch et al. | 187/401 |

FOREIGN PATENT DOCUMENTS

| | | | |
|---|---|---|---|
| JP | 7061734 | A | 3/1995 |
| JP | 2004161404 | A | 6/2004 |
| JP | 2005060008 | A | 3/2005 |
| JP | 2009190843 | A | 8/2009 |

* cited by examiner

*Primary Examiner* — William A Rivera
*Assistant Examiner* — Michael Riegelman
(74) *Attorney, Agent, or Firm* — Fraser Clemens Martin & Miller LLC; William J. Clemens

(57) ABSTRACT

A fire service elevator includes an elevator cage with a cage roof, wherein the elevator cage is at least partly supported and driven by at least one support device, wherein the elevator cage is looped under by the at least one support device, wherein the elevator cage has a protective element, which is arranged at least partly around the at least one support means and disposed substantially on the cage roof. The protective element screens the at least one support device relative to a central region of the cage roof so that extinguishing water falling onto the cage roof in the case of fire is substantially prevented from wetting the at least one support device.

11 Claims, 3 Drawing Sheets

FIRE SERVICE ELEVATOR

CROSS-REFERENCE TO RELATED APPLICATION

This application claims priority to European Patent Application No. 11161765.0, filed Apr. 8, 2011, which is incorporated herein by reference.

FIELD

The present disclosure relates to a fire service elevator.

BACKGROUND

Modern elevator installations or so-called fire service elevators, which are designed additionally for this purpose, should provide reliable operation even in the case of fire. On the one hand evacuation of persons and/or material, which is at risk, from the stories affected by the fire should be ensured and on the other hand a functionally capable elevator should be available for the transport of fire service personnel and their extinguishing material. In both cases the use of extinguishing water should not have the consequence that the elevator installation or the fire service elevator no longer functions. This applies not only to the use of a sprinkler installation on a story, but also to the use of extinguishing water by the fire service.

This means that electric components of the elevator installation should remain dry. Moreover, it should be ensured that a support means is still driven as intended on a drive pulley. Extinguishing water can in that case negatively influence the traction of the support means on the drive pulley. On the one hand, extinguishing water can directly reduce the coefficients of friction between the drive pulley and the support means and on the other hand lubricant present in the extinguishing water can in addition negatively influence the traction between the support means and the drive pulley. A support means wetted by extinguishing water can thus lead to a reduction of traction or even to a complete loss of traction. Particularly in the case of a substantial difference between the weight of the elevator cage and a counterweight an uncontrolled travel of the elevator cage can in that case arise, which has to be stopped by safety brakes.

The use of belt-like support means instead of steel cables can have the problem of additionally amplifying the loss of traction between support means and drive pulley. The synthetic material surfaces of belt-like support means sometimes change their traction characteristics in the case of wetting by extinguishing water more strongly than support means of steel cable form. This can make it necessary to conduct away the extinguishing water in controlled manner or to catch it. It can be necessary to prevent traction means sections which co-operate with the drive pulley from being wetted by extinguishing water.

The extinguishing water normally penetrates over the shaft doors of the elevator shaft into the elevator shaft. In that case the extinguishing water flows onto a story floor below the shaft doors through into the elevator shaft.

SUMMARY

Various embodiments disclosed herein comprise a device for protection of the support means from extinguishing water.

In at least some embodiments, a fire service elevator with an elevator cage comprises a cage roof, wherein the elevator cage is at least partly supported and driven by at least one support means and wherein the elevator cage is looped under by the at least one support means. The elevator cage comprises at least one protective element, which is arranged at least partly around the at least one support means and disposed substantially on the cage roof. The at least one protective element screens the at least one support means relative to a central region of the cage roof, so that extinguishing water falling onto the cage roof in the case of fire is substantially prevented from wetting the at least one support means.

In further embodiments, a drain system is arranged at the outset not at the individual shaft doors, but at the elevator cage itself. This basic concept derives from recognition that the extinguishing water does not necessarily have to be kept away from the elevator shaft, but can also flow away in controlled or deflected manner. It was observed that a common reason of the support means becoming wet is the spraying or atomization of the extinguishing water when impinging on the roof of the elevator cage.

In some embodiments, the support means is screened towards at least one further side additionally to the side towards the central region of the cage roof. In further embodiments, the support means is screened towards at least two further sides.

In some cases, two protective elements are provided for each support means, namely a respective first protective element substantially over a first side wall of the cage and a second protective element substantially over the second side wall of the cage. Because the extinguishing water drops through slots under the shaft doors into the shaft, in some cases it is important to equip with protective elements those support means which are arranged closer to the shaft doors.

In particular embodiments, modifications or, in particular, constructional measures do not have to be undertaken either at the elevator itself or at the elevator shaft. The proposed protective element can, for example, also be retrofitted to existing elevator installations in simple mode and manner. Moreover, this proposed solution can be economic.

In further embodiments, elevator cages of different types can be retrofitted. The protective element can be arranged on any of planar, chamfered and even irregularly shaped cage roofs. This can enable retrofitting of the extinguishing water deflecting system to almost all elevator types. The protective element can thus be interpreted as an additional component which can be arranged on existing, intrinsically closed elevator cages.

The at least one protective element screens the at least one support means relative to the central region of the cage roof. By central region of the cage roof there is understood a region of the cage roof which is hit by extinguishing water dropping down. Depending on the respective configuration of the elevator this central region can be of different construction with respect to size, position and shape.

In some embodiments, the protective element is used in fire service elevators which have support means with a synthetic material casing, such as, for example, belts. The protective element can equally well be used with support means without synthetic material encasing, such as, for example, steel cables, but here the traction loss due to wetting of the support means by extinguishing water is less serious than in the case of support means encased by synthetic material. Such belts usually have a casing of synthetic material arranged around a plurality of tensile carriers disposed parallel to one another. The tensile carriers can be constructed from, for example, steel wires or synthetic fibers.

In some embodiments, two protective elements are provided for each support means, wherein with respect to a support means a first protective element is arranged substantially above a first cage side wall and a second protective element is arranged substantially above a second cage side wall. Several support means extending parallel to one another can be arranged, wherein each of these support means loops under the elevator cage. In that case, one or two protective elements can be associated with each support means or even with only those support means which due to an elevator configuration are particularly affected by spraying extinguishing water.

So as not to limit travel of the elevator cage in the direction of the shaft head, the protective element is possibly constructed in such a manner that in a use state it does not project above other components of the elevator cage. The height of the protective element is therefore possibly selected so that the protective element does not project above a balustrade. The height of the protective element is, for example, possibly 20 centimeters to 100 centimeters, possibly 30 centimeters to 80 centimeters, possibly 40 centimeters to 60 centimeters.

The protective element can be made from various kinds of materials. The protective element possibly consists of an economic, robust and light material which can be shaped or produced by simple methods. An example of such a material is sheet metal. Alternatively thereto, for example, use can also be made of different synthetic materials. The wall thickness of the protective element is, for example, possibly between 0.5 millimeters and 30 millimeters, possibly between 1 millimeter and 10 millimeters, possibly between 1 millimeter and 5 millimeters.

The protective element can be substantially arranged on the cage roof of the elevator cage. In that case the protective element can, for example, be fastened on the cage roof itself or to a cage frame. Depending on the respective configuration of the elevator cage, fastening of the protective element can be carried out in different ways. In that case it can be important that the protective element screens the support means, which runs past the elevator cage, relative to a central region of the cage roof. It is also possible, for example, to fasten the protective element to a cage side wall so that the protective element extends above a plane of the cage roof.

The protective element can be shaped in various ways. Possible forms are elongate elements with a U-shaped, a V-shaped, an oval, a rectangular or a round cross-section. However, other shapes are also usable. For example, use can also be made of beveled or irregularly shaped elements. It can be important for the selection of the shape that the support means is screened by the protective element at least relative to the central region of the cage roof.

BRIEF DESCRIPTION OF THE DRAWINGS

The disclosure is explained in more detail using the figures, in which.

DETAILED DESCRIPTION

Fire service elevators can include elevators which have special adaptations so that they can remain capable of use longer in the case of fire. Such adaptations can include, for example, electronic components protected against spray water, fireproof cage elements or a specific control mode for the case of fire. The protective element is similarly such an adaptation. In this sense, any elevator which is equipped with such a protective element is termed a fire service elevator herein.

Figure 1:
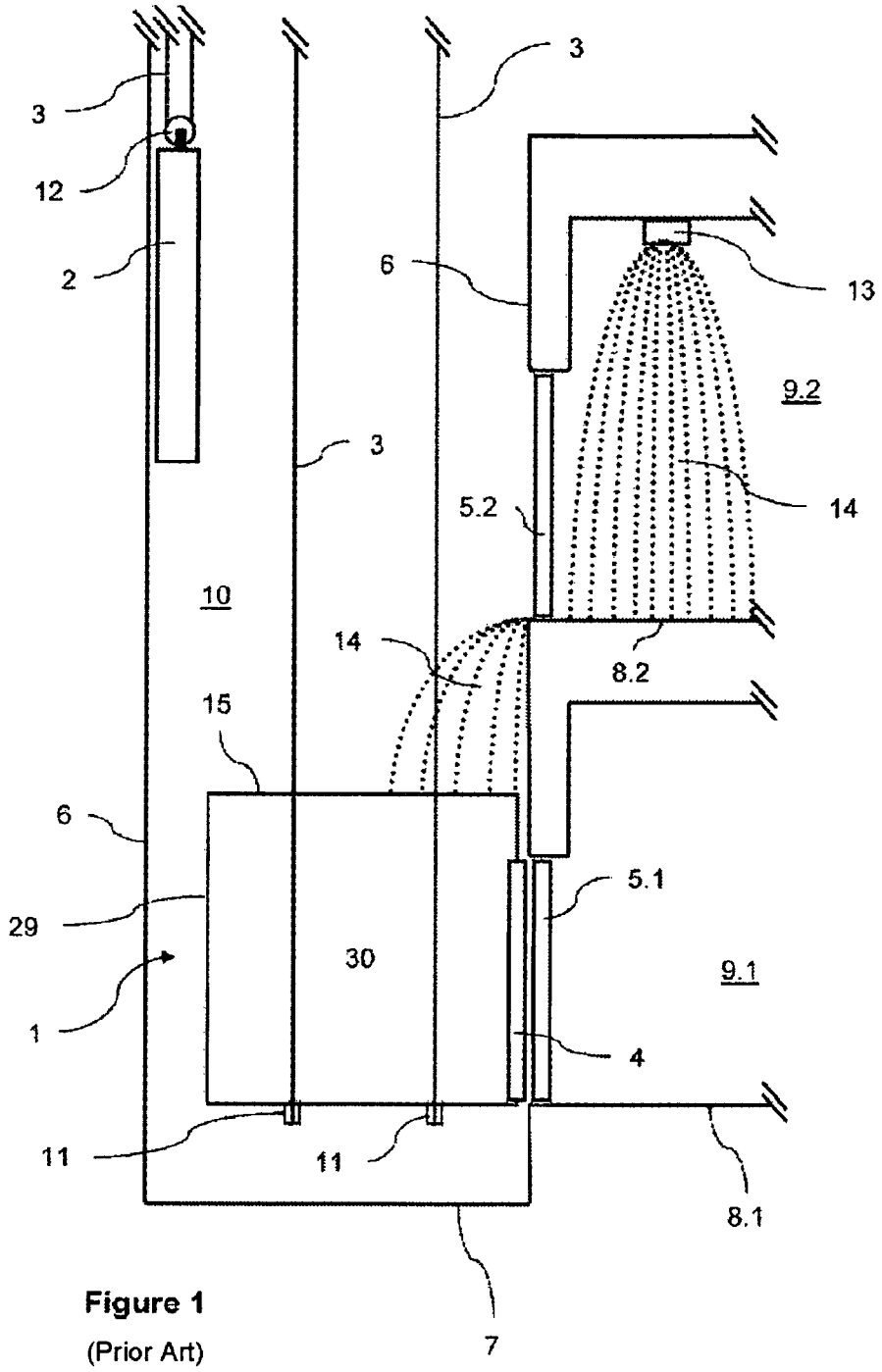
Figure 1 (Prior Art)
FIG. 1 shows a schematic illustration of an exemplifying elevator installation in a building with a fire extinguishing installation.

FIG. 1 shows an elevator installation such as is known from the prior art. A cage 1 and a counterweight 2 are arranged in an elevator shaft 10. In that case, both the elevator cage 1 and the counterweight 2 are coupled with a support device or means 3. The elevator cage 1 and the counterweight 2 can be vertically moved in the shaft 10 by driving the support means 3 by a drive (not illustrated). In the illustrated exemplifying embodiment not only the elevator cage 1, but also the counterweight 2 are suspended at support rollers 11, 12. The cage support rollers 11 are in that case arranged below the cage 1 so that the cage 1 is looped under by the support means 3. By contrast thereto the counterweight support roller 12 is arranged above the counterweight 2 so that the counterweight 2 is suspended at the counterweight support roller 12. Through the looping-under of the elevator cage 1 the support means 3 is guided along cage side walls 30.

A shaft wall 6 has a respective opening at the height of each story 9.1, 9.2, which opening can be closed by a respective shaft door 5.1, 5.2. A fire extinguishing installation 13 is installed on the second-lowermost story 9.2. The fire extinguishing installation 13 is arranged at a ceiling of the story 9.2 so that extinguishing water 14 can reach the largest possible number of fire locations. The extinguishing water 14 collects on the story floor 8.2 and flows from there, at least partly, through under the shaft door 5.2 and into the elevator shaft 10. As illustrated in FIG. 1, the extinguishing water 14 flowing through the shaft door 5.2 can drop in the manner of a waterfall from above onto the elevator cage 1. From the elevator cage 1 the extinguishing water 14 flows further down until it collects at the shaft floor 7 (not illustrated).

The distribution of the extinguishing water 14 in the elevator shaft 10 is dependent on, inter alia, the following factors: For entry of the extinguishing water 14 into the elevator shaft 10 the extinguishing water quantity and also a gap size between the shaft door 5.2 and the story floor 8.2 are at the outset critical. The larger the quantity of extinguished water, the greater the water pressure which can shoot the extinguishing water into the shaft. The shape and size of the gap between the shaft door 5.2 and the story floor 8.2 have a direct influence on the distribution of the extinguishing water 14 in the elevator shaft 10. In addition, the distribution of the extinguishing water 14 in the elevator shaft 10 is influenced by the height difference between the elevator cage 1 and the story 9.2 from which the extinguishing water 14 penetrates into the shaft 10. The greater the spacing between a cage roof 15 and the story floor 8.2 from which the extinguishing water 14 penetrates into the shaft 10 the more rapidly the extinguishing water 14 falls onto the elevator cage roof 15 and the further the extinguishing water 14 is sprayed from the cage roof 15. A larger spacing between the cage roof 15 and the story floor 8.2 from which the extinguishing water penetrates into the shaft 10 additionally has the consequence that the extinguishing water can propagate more widely and deeply in the shaft 10 due to a higher drop path.

The principles and issues described with respect to FIG. 1 can also occur with different kinds of fire extinguishing installations or different kinds of elevators.

Various exemplifying embodiments of a protective element 16 are illustrated in FIGS. 2*a* to 2*d*. The protective element 16 has a height 17. The height 17 corresponds with the section of the support means 3 which can be screened by the protective element 16. On the one hand this height 17 is to be as large as possible so as to protect a largest possible section of the support means 3 from spraying extinguishing water. On the other height, this height 17 is not to be so large that a movement of the elevator cage in the direction of a shaft head (not illustrated) is restricted by the protective element 16. In some embodiments, a height 17 of approximately 50 centimeters can be used.

Figure 2A:
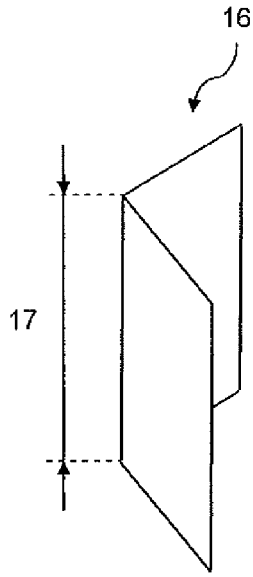
FIG. 2*a* shows an exemplifying form of embodiment of a protective element.

FIG. 2*a* shows an exemplifying protective element 16 with a V-shaped cross-section. This form of embodiment is particularly simple to produce and nevertheless screens the support means from two or three sides depending on how this protective element 16 is arranged.

Figure 2B:
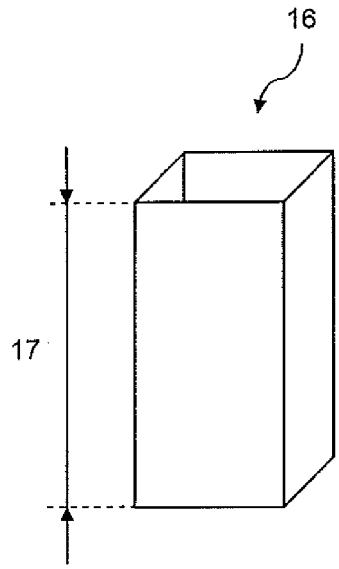
FIG. 2*b* shows an exemplifying form of embodiment of a protective element.

FIG. 2*b* shows an exemplifying protective element 16 with a rectangular cross-section. This protective element 16 can provide that the support means is screened from all sides. However, the support means is introduced through this protective element 16, which can make subsequent installation of the protective element 16 on an existing elevator cage difficult.

Figure 2C:
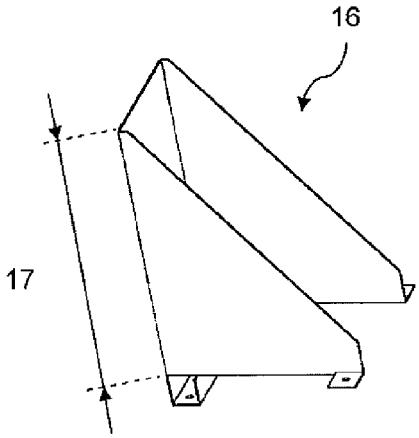
FIG. 2*c* shows an exemplifying form of embodiment of a protective element.

FIG. 2*c* shows an exemplifying protective element 16 with U-shaped cross-section. This protective element 16 is, in addition, beveled. This protective element 16 is so arranged on the elevator cage that a maximum height 17 is arranged between the support means to be screened and the central region of the cage roof. In the case of this exemplifying embodiment, elements for fastening the protective element 16 to the elevator cage are in addition illustrated.

Figure 2D:
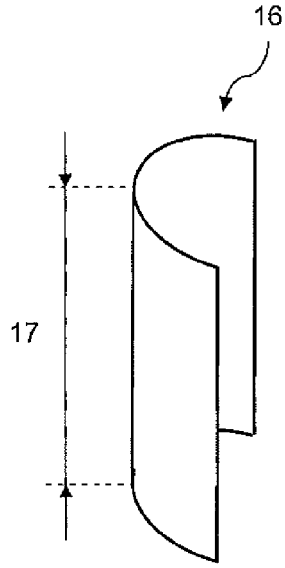
FIG. 2*d* shows an exemplifying form of embodiment of a protective element.

FIG. 2*d* shows an exemplifying protective element 16 with a U-shaped cross-section. The protective element 16 in this form of embodiment is similar to the protective element in FIG. 2*a*, but the cross-section is U-shaped instead of the V-shaped cross-section in FIG. 2*a*.

In all exemplifying forms of embodiment of the protective elements 16 in FIGS. 2*a* to 2*d*, the protective element 16 is so constructed that a support means can be screened by that from at least two sides. Possibly, the protective element 16 is so arranged that the support means is screened from three sides. In at least some embodiments, the support means is screened at least relative to the central region of the cage roof.

Figure 3:
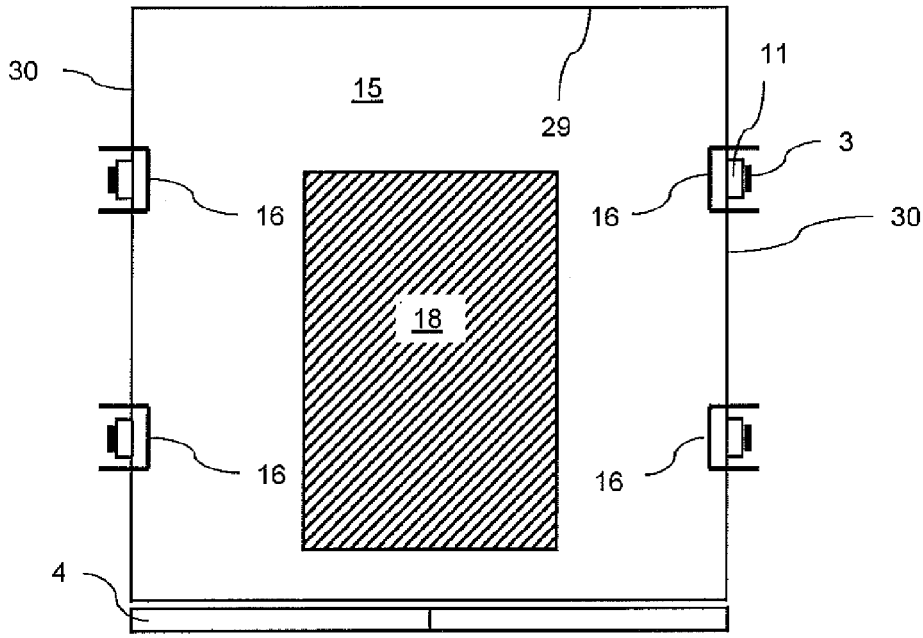
FIG. 3 shows an exemplifying form of embodiment of an elevator cage in plan view.

An exemplifying form of embodiment of an elevator cage is illustrated in plan view in FIG. 3. The elevator cage is laterally bounded by the side walls 30, the back wall 29 and the cage doors 4. Also illustrated are the support means 3 which are guided through from the cage support rollers 11 below the elevator cage 1. A central region 18 is illustrated on the cage roof 15. The support means 3 are screened by support elements 16 towards the central region 18 of the cage roof 15 and towards two further sides. Two protective elements 16 are associated with each support means 3.

Figure 4:
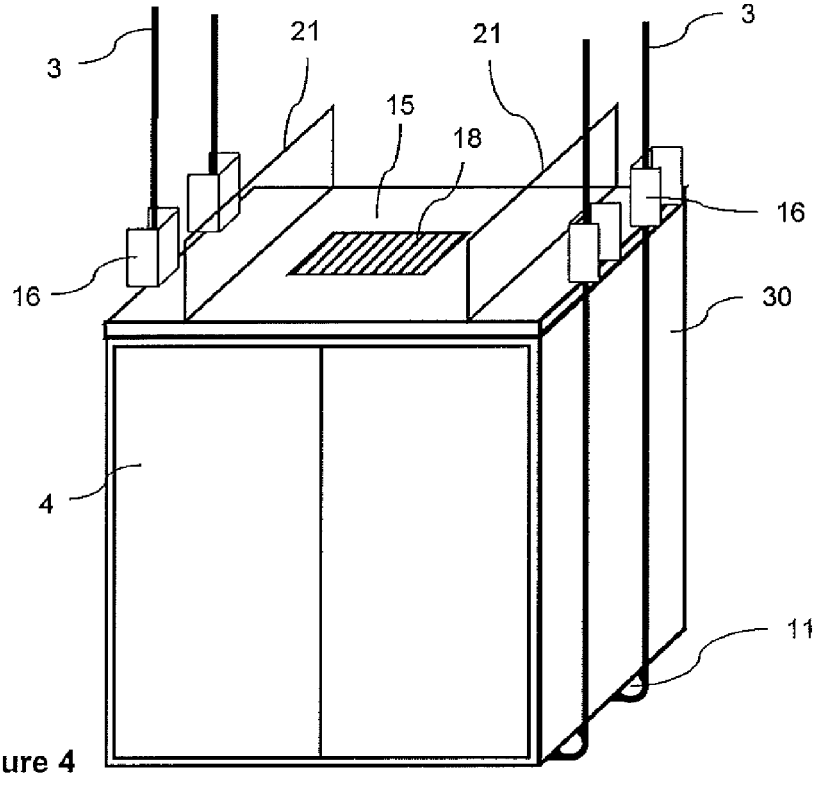
FIG. 4 shows an exemplifying form of embodiment of an elevator cage with a protective element in three-dimensional illustration.

FIG. 4 shows an exemplifying form of embodiment of an elevator cage in three-dimensional illustration. Here, too, the elevator cage is looped under by two support means 3, wherein the support means 3 are guided by support rollers 11 around the elevator cage. Each support means 3 is screened by two support elements 16 towards the central region of the cage roof 15 and towards two further sides. The exemplifying central region 18 in FIG. 4 differs in size, position and shape from the exemplifying central region in FIG. 3.

The protective elements 16 in FIG. 4 are so constructed that they do not project above balustrades 21 arranged on the cage roof 15. Movement of the elevator cage in the direction of the shaft head (not illustrated) is thereby not additionally restricted by the protective element 16.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. A fire service elevator, comprising:

an elevator cage arranged in an elevator shaft, the elevator cage comprising a cage roof exposed to water falling in the elevator shaft from above the elevator cage;

a support device, the support device extending from above the elevator cage, guided along opposed side walls of the cage and passing under the elevator cage; and a protective element arranged on the elevator cage, the protective element being positioned to screen a portion of the support device above a plane of the cage roof relative to a central region of the cage roof to protect the portion of the support device from the water falling onto and being sprayed from the central region of the cage roof, the protective element U-shaped and having three element walls positioned to screen the support device, with a central one of the element walls contacting the cage roof and facing toward the central region of the cage roof and an opening opposite the central one of the element walls facing away from the central region of the cage roof such that the water falling onto the central region is blocked from contacting a portion of the support device positioned within the opening of the protective element.

2. The fire service elevator of claim 1, the support device comprising a belt.

3. The fire service elevator of claim 1, the elevator cage further comprising opposing first and second side walls, the protective element being a first protective element, the elevator further comprising a second protective element, the first protective element being arranged above the first side wall and the second protective element being arranged above the second side wall.

4. The fire service elevator of claim 1, the elevator cage further comprising a balustrade positioned on the cage roof, the protective element having a height not greater than a height of the balustrade.

5. The fire service elevator of claim 1, the protective element having a height between 20 centimeters and 100 centimeters.

6. The fire service elevator of claim 1, the protective element comprising sheet metal.

7. The fire service elevator of claim 1, the protective element having a element wall thickness between 1 millimeter and 5 millimeters.

8. The fire service elevator of claim 1, the protective element being fastened to the cage roof.

9. The fire service elevator of claim 1, the protective element comprising a beveled region, the beveled region being angled from a maximum height toward the central region of the cage roof.

10. An elevator cage, comprising:

a cage roof;

opposing first and second side walls; and a protective element arranged on the cage roof, the protective element being positioned to screen a portion of a support device above a plane of the cage roof relative to a central region of the cage roof, the protective element U-shaped and having three element walls positioned to screen a portion of the support device, with a central one of the element walls contacting the cage roof and facing toward the central region of the cage roof, the protective element further including an opening defined between the three element walls facing away from the central region of the cage roof such that the water falling onto the central region is blocked from contacting the portion of the support device positioned within the opening of the protective element, and a beveled region angled from a maximum height toward the central region of the cage roof, the protective element protecting the portion of the support device from water falling onto and being sprayed from the central region of the cage roof.

11. The elevator cage of claim 10, the support device comprising a belt.

* * * * *